US012742378B2

(12) United States Patent
Neufeldt

(10) Patent No.: US 12,742,378 B2
(45) Date of Patent: Sep. 22, 2026

(54) CONTROLLING A DRILLING OPERATION BASED ON STORED TORQUE IN A DRILL STRING

(71) Applicant: Pason Systems Corp., Calgary (CA)

(72) Inventor: Adam Chase Neufeldt, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 0 days.

(21) Appl. No.: 19/088,456

(22) Filed: Mar. 24, 2025

(65) Prior Publication Data

US 2026/0251047 A1 Aug. 27, 2026

(30) Foreign Application Priority Data

Feb. 27, 2025 (CA) ..... CA 3266407

(51) Int. Cl.
*E21B 44/00* (2006.01)
*E21B 3/02* (2006.01)

(52) U.S. Cl.
CPC ..... *E21B 44/00* (2013.01); *E21B 3/022* (2020.05)

(58) Field of Classification Search
CPC ..... E21B 44/00; E21B 3/022
See application file for complete search history.

(56) References Cited

U.S. PATENT DOCUMENTS 6,050,348 A * 4/2000 Richarson ..... E21B 44/005 175/26
6,918,453 B2 7/2005 Haci et al.
7,096,979 B2 8/2006 Haci et al.
7,152,696 B2 12/2006 Jones
7,588,099 B2 9/2009 Kracik
7,823,655 B2 11/2010 Boone et al.
(Continued)

FOREIGN PATENT DOCUMENTS

CA 2525382 11/2004
CA 2525371 12/2004
(Continued)

OTHER PUBLICATIONS

Han, G., Lemesany, L., Azizov, A.A., DeLeon, F., all Baker Hughes. SPE 167141—Practical Directional Drilling Techniques in Pinedale Field Wyoming To Improve Drilling Performance. Society of Petroleum Engineers, SPE Unconventional Resources Conference—Canada, Nov. 2013.

(Continued)

*Primary Examiner* — D. Andrews
(74) *Attorney, Agent, or Firm* — D'Ambrosio & Menon, PLLC; Usha Menon

(57) ABSTRACT

A method of controlling drilling of a wellbore includes obtaining, during oscillation of a drill string, one or more measured torque values at one or more rotational positions of the drill string, wherein the oscillation alternates the drill string's rotation in clockwise and counter-clockwise directions. A torsional compliance of the drill string is determined based on physical or operational parameters. Using the measured torque values and the torsional compliance, a stored torque in the drill string is calculated. The drilling operation is then controlled by adjusting one or more drilling parameters based on the determined stored torque to maintain operational stability and toolface orientation.

30 Claims, 7 Drawing Sheets

(56) References Cited

U.S. PATENT DOCUMENTS

| | | | | |
|---|---|---|---|---|
| 10,036,678 | B2 | 7/2018 | Fisher et al. | |
| 10,190,402 | B2 | 1/2019 | Dykstra et al. | |
| 10,358,904 | B2 | 7/2019 | Kyllingstad | |
| 10,612,307 | B2 | 4/2020 | Summers et al. | |
| 10,830,033 | B2 | 11/2020 | Weideman et al. | |
| 10,954,773 | B2 | 3/2021 | Benson et al. | |
| 10,975,679 | B2 * | 4/2021 | Samuel | E21B 47/022 |
| 11,352,871 | B2 * | 6/2022 | Pabon | E21B 44/04 |
| 11,549,357 | B2 | 1/2023 | Neufeldt et al. | |
| 2002/0104685 | A1 | 8/2002 | Pinckard et al. | |
| 2004/0211596 | A1 | 10/2004 | Huang | |
| 2017/0037722 | A1 | 2/2017 | Jeffreys et al. | |
| 2017/0306702 | A1 | 10/2017 | Summers et al. | |
| 2019/0048707 | A1 | 2/2019 | Benson et al. | |
| 2019/0187012 | A1 * | 6/2019 | Wu | E21B 47/007 |
| 2019/0218901 | A1 | 7/2019 | Groover | |
| 2020/0063546 | A1 | 2/2020 | Weideman et al. | |
| 2020/0165913 | A1 | 5/2020 | Benson et al. | |
| 2021/0025269 | A1 | 1/2021 | Zaripov | |
| 2022/0127923 | A1 * | 4/2022 | Matheus Valero | E21B 44/04 |

FOREIGN PATENT DOCUMENTS

| | | |
|---|---|---|
| CA | 2582365 | 4/2006 |
| CA | 2636249 | 8/2007 |
| CA | 2700258 | 3/2009 |
| CA | 2921163 | 4/2015 |
| CA | 2938521 | 9/2015 |

OTHER PUBLICATIONS

Well Engineers Notebook, Feb. 1998, 4th Edition, May 2003, Shell International Exploration And Production B.V., EP Learning And Development.

* cited by examiner

CONTROLLING A DRILLING OPERATION BASED ON STORED TORQUE IN A DRILL STRING

CROSS-REFERENCE TO RELATED APPLICATIONS

This application is related to and claims priority to Canadian Patent Application No.: 3,266,407 filed on Feb. 27, 2025, the contents of which are incorporated by reference herein.

TECHNICAL FIELD

The present disclosure relates to methods, systems, and techniques for controlling drilling operations in a wellbore. More particularly, the present disclosure relates to methods, systems, and techniques for controlling a drilling operation based on torque stored in a drill string.

BACKGROUND

Oil and gas wellbore drilling often involves the rotation of a drill string to drive a drill bit into subsurface formations. The drill string experiences various mechanical forces during operation, including torque generated by the rotation of the topdrive or other drive systems. This torque is transmitted along the drill string to the drill bit, enabling penetration into the formation. Sensors and control systems are typically employed to monitor parameters to ensure operational stability during drilling.

The mechanical behavior of the drill string is complicated by the accumulation of stored torque along its length. This stored torque can result from various operational factors, such as residual torque left over from previous drilling operations, topdrive adjustments, or downhole torque spikes. As this torque propagates through the drill string, it can influence the orientation of the toolface, resulting in potential directional inaccuracies. At greater depths, the effects of stored torque on the toolface can persist for extended periods of time, which complicates efforts to maintain precise control during directional drilling.

SUMMARY

According to a first aspect of the disclosure, there is provided a method of using one or more computer processors to control drilling of a wellbore, comprising: obtaining, during oscillating of a drill string, one or more measured torque values at one or more rotational positions of the drill string, wherein during the oscillating the drill string is alternately rotated in clockwise and counter-clockwise directions; determining a torsional compliance of the drill string; determining a stored torque using the one or more measured torque values at the one or more rotational positions and using the torsional compliance; and controlling the drilling of the wellbore based on the stored torque.

According to one embodiment, the one or more rotational positions may comprise a clockwise oscillation peak and a counter-clockwise oscillation peak, and determining the stored torque may comprise determining the stored torque using respective measured torque values at the clockwise and counter-clockwise oscillation peaks and using the torsional compliance.

According to one embodiment, the respective measured torque values may be respective maximum measured torque values obtained when oscillating the drill string in the clockwise and counter-clockwise directions.

According to one embodiment, the respective measured torque values may be respective maximum measured torque values obtained at maximum angular displacements, in the clockwise and counter-clockwise directions, of a topdrive connected to the drill string.

According to one embodiment, determining the stored torque may comprise: determining the stored torque by using the measured torque value at the clockwise oscillation peak and the measured torque value at the counter-clockwise oscillation peak.

According to one embodiment, the drill string may be oscillated while a drill bit of the drill string is spaced from a bottom of the wellbore.

According to one embodiment, the drill string may be oscillated while a drill bit of the drill string is in contact with a bottom of the wellbore, and determining the stored torque may further comprise subtracting a reactive torque from the corresponding measured torque value at the clockwise or counter-clockwise oscillation peak, respectively.

According to one embodiment, the one or more rotational positions may comprise one or more intermediate rotational positions, and determining the stored torque may comprise determining the stored torque using one or more measured torque values obtained when the drill string is at the one or more intermediate rotational positions and using the torsional compliance.

According to one embodiment, during the oscillating, the drill string may rotate at a constant rotational speed during a steady phase, and the one or more intermediate rotational positions may be rotational positions of the drill string during the steady phase.

According to one embodiment, the steady phase may comprise a period during which the drill string is rotated at an angular velocity above a predetermined threshold value.

According to one embodiment, determining the stored torque may comprise: determining a twist oscillating torque at each of the plurality of intermediate rotational positions using the torsional compliance and a difference between an angular displacement of a topdrive connected to the drill string and a predetermined neutral position of the topdrive; determining a net torque at each of the one or more intermediate rotational positions by subtracting the twist oscillating torque from the measured torque value at the corresponding intermediate rotational position; and determining the stored torque by averaging the net torques over the one or more intermediate rotational positions in the clockwise and counter-clockwise directions.

According to one embodiment, the drill string may be oscillated while a drill bit of the drill string is spaced from a bottom of the wellbore.

According to one embodiment, the drill string may be oscillated while a drill bit of the drill string is in contact with a bottom of the wellbore, and determining the net torque may further comprise subtracting a reactive torque from the measured torque value.

According to one embodiment, the torsional compliance of the drill string may be determined using one or more dimensions and a material property of the drill string.

According to one embodiment, the drill string may comprise a plurality of segments, the one or more dimensions may comprise an outer diameter of each of the plurality of segments, an inner diameter of each of the plurality of segments, and a length of each of the plurality of segments, and the material property may comprise a shear modulus of a material of each of the plurality of segments.

According to one embodiment, the torsional compliance may be calculated by: $\lambda_{total}=\Sigma\lambda_i$, wherein $$\lambda_i = \frac{1}{G \cdot J} \cdot L,$$

wherein $\lambda_{total}$ represents the torsional compliance of the drill string, $\lambda_i$ represents the torsional compliance for the i-th segment, G represents the shear modulus of the material of the i-th segment, L represents the length of the i-th segment, and J represents a torsional moment of inertia calculated by:

$$J = \frac{\pi}{32} \cdot (OD^4 - ID^4),$$

wherein OD represents the outer diameter of the i-th segment, and ID represents the inner diameter of the i-th segment.

According to one embodiment, controlling the drilling operations may comprise: determining at least one of a corrected topdrive position setpoint, a corrected differential pressure setpoint, a corrected weight-on-bit (WOB) setpoint, or a corrected rate of penetration (ROP) setpoint based on the stored torque; and adjusting at least one of the following to counteract an effect of the stored torque on the toolface orientation: a toolface orientation of a drill bit connected to the drill string based on the corrected topdrive position setpoint, to counteract an effect of the stored torque on the toolface orientation; a differential pressure applied to a mud motor based on the corrected differential pressure setpoint; a weight-on-bit applied to the drill bit based on the corrected WOB setpoint; and a drilling rate based on the corrected ROP setpoint.

According to one embodiment, the method may further comprise: iteratively determining the stored torque during the oscillating by continuously obtaining updated measured torque values at one or more rotational positions of the drill string.

According to one embodiment, during the oscillating, the drill string may rotate at a constant rotational speed during a steady phase, and determining the torsional compliance of the drill string may comprise: determining one or more instantaneous torsional compliances during the steady phase in a time interval, based on a ratio of a difference in angular displacement of a topdrive connected to the drill string and a corresponding difference in measured torque; and filtering the one or more instantaneous torsional compliance values using an exponential filter to obtain a smoothed torsional compliance as the torsional compliance.

According to one embodiment, the one or more instantaneous torsional compliances may be calculated by:

$$\lambda_{inst} = \frac{\text{difference in angular displacement}}{\text{difference in torque}},$$

wherein $\lambda_{inst}$ represents the instantaneous torsional compliance, and wherein the calculation of the one or more instantaneous torsional compliances is performed if the following conditions are met: the constant rotational speed is greater than a predetermined speed value, signs of the angular displacement difference and torque difference match, and a magnitude of the torque difference exceeds a predetermined torque value.

According to a second aspect of the disclosure, there is provided a non-transitory computer-readable medium having stored thereon computer program code configured when executed by one or more processors to cause the one or more processors to perform a method of controlling drilling of a wellbore, comprising: obtaining, during oscillating of a drill string, one or more measured torque values at one or more rotational positions of the drill string, wherein during the oscillating the drill string is alternately rotated in clockwise and counter-clockwise directions; determining a torsional compliance of the drill string; determining a stored torque using the one or more measured torque values at the one or more rotational positions and using the torsional compliance; and controlling the drilling of the wellbore based on the stored torque.

According to a second aspect of the disclosure, there is provided a drilling rig comprising: a drill string having a drill bit at end thereof for drilling a wellbore; one or more sensors for measuring rotational position of the drill string and torque of the drill bit, wherein the rotational position is indicative of an angular displacement of a topdrive connected to the drill string; and one or more processors configured to receive as inputs real-time measurements of the rotational position and the torque obtained by the one or more sensors, and configured to: obtain, during oscillating of a drill string, one or more measured torque values at one or more rotational positions of the drill string, wherein during the oscillating the drill string is alternately rotated in clockwise and counter-clockwise directions; determine a torsional compliance of the drill string; determine a stored torque using the one or more measured torque values at the one or more rotational positions and using the torsional compliance; and control the drilling of the wellbore based on the stored torque.

This summary does not necessarily describe the entire scope of all aspects. Other aspects, features, and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

Figure 1:
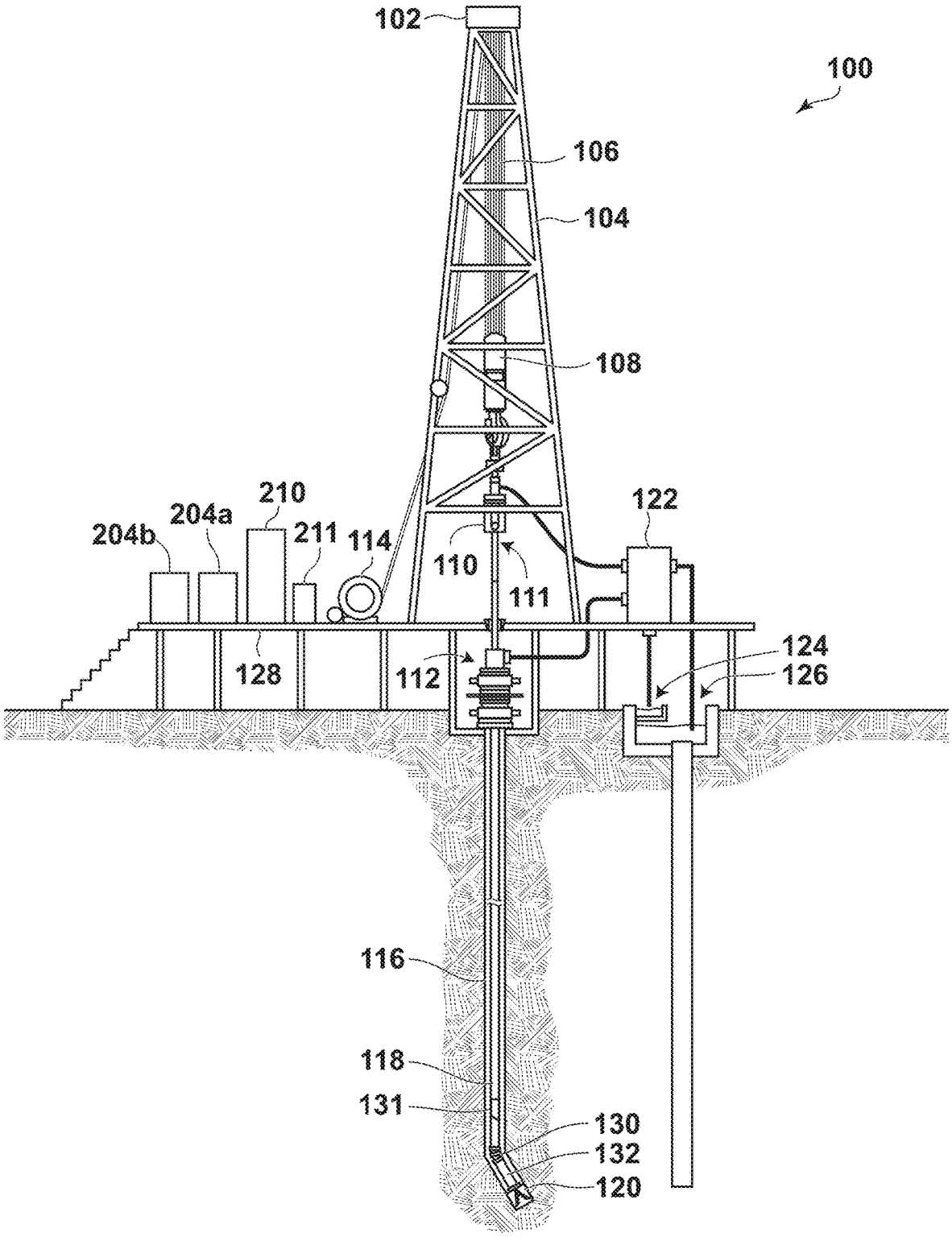
FIG. 1 is a schematic diagram of a drilling rig, according to an embodiment of the disclosure.

The present disclosure seeks to provide novel methods, systems, and computer-readable media for controlling a drilling operation based on stored torque. While various embodiments of the disclosure are described below, the disclosure is not limited to these embodiments, and variations of these embodiments may well fall within the scope of the disclosure.

Torsional compliance refers to the relationship between applied torque and the resulting angular displacement of a drill string or its segments. It represents the mechanical flexibility of the drill string in response to torsional forces. According to the embodiments described herein, torsional compliance may be determined using the physical properties of the drill string, or it may be calculated dynamically based on real-time measurements of torque and angular displacement.

Stored torque refers to residual torque that accumulates within the drill string due to operational factors such as rotary drilling, previous sliding operations, topdrive adjustments, or downhole events like torque spikes. This stored torque propagates through the drill string and can influence the orientation of the toolface, potentially leading to directional inaccuracies if not accounted for during drilling operations.

In the context of this disclosure, oscillation involves alternating rotational movements of the drill string in clockwise (CW) and counter-clockwise (CCW) directions. This controlled oscillatory motion generates measurable torque variations which are used to analyze the mechanical behavior of the drill string and to determine stored torque.

As described above, during drilling operations, residual torque stored in the drill string can accumulate from various sources, including rotary drilling, prior sliding operations, topdrive adjustments, faults in the topdrive or variable frequency drive (VFD), and downhole torque spikes. This stored torque can propagate through the drill string and influence the toolface orientation unpredictably for extended periods, especially at greater depths. Such unpredictable effects on the toolface may lead to directional inaccuracies and operational inefficiencies. Current industry practices either involve "working" the drill pipe (moving it up and down) to release the torque gradually or attempting to account for the stored torque through approximations or manual adjustments of the topdrive turns and autodriller setpoints. However, these approaches lack precision and can lead to suboptimal drilling performance or unintended consequences.

Generally, according to embodiments of the disclosure, there is described a method of dynamically managing stored torque in the drill string to improve directional drilling performance and stability. The method includes obtaining real-time measurements of torque at various rotational positions during oscillation of the drill string. The oscillation involves alternating rotational movement in clockwise and counter-clockwise directions, generating measurable torque variations. The torque data is processed to calculate the stored torque within the drill string, using the torsional compliance of the drill string.

In response to determining the stored torque, a torque adjustment operation may be activated. This operation may adjust a topdrive position setpoint to mitigate the effects of the stored torque on the toolface orientation. The topdrive position setpoint refers to a target angular displacement for the topdrive relative to a predetermined neutral position. This setpoint guides the topdrive's rotational adjustments, and setpoint adjustments are used to control the angular movement of the drill string.

For example, if a significant amount of stored torque is detected and that would cause the toolface to deviate from the intended trajectory, the topdrive position setpoint may be adjusted to apply corrective rotations to the drill string. These adjustments counteract the influence of the stored torque to allow the toolface to remain aligned with the desired drilling path, thereby improving directional accuracy and operational stability.

Additionally, for on-bottom scenarios where the drill bit contacts the formation when the determination of stored torque is carried out, the operation may adjust other autodriller setpoints, such as differential pressure, weight-on-bit (WOB), or rate of penetration (ROP), to account for stored torque and maintain desired drilling performance. These adjustments may further assist in mitigating the influence of stored torque and ensuring consistent directional control.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a travelling block 108 via a crown block 102. The travelling block 108 is connected to the drill string 118 via a top drive 110. The top drive 110 is connected to the drill string 118 by a tubular section known as a quill 111. Rotating the drawworks 114 consequently is able to change WOB during drilling, with rotation in one direction lifting the travelling block 108 and generally reducing WOB and rotation in the opposite direction lowering the travelling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Up-hole of the bent sub 130 is located a measurement-while-drilling (MWD) tool 131. MWD tool 131 collects and transmits data from inside the wellbore 116, such as formation properties, rotational speed, vibration, temperature, torque, pressure, and mud flow. The MWD tool 131 measures the inclination, azimuth, and toolface orientation of a downhole tool near the drill bit 120. Toolface orientation (or simply "toolface") combined with inclination, azimuth, and the geometry of the bottom hole assembly can be used to determine the trajectory of the drill string 118.

The MWD data may be transferred to the surface using any of various means, such as mud pulse telemetry, electromagnetic telemetry (generally for relatively shallow depths), acoustic telemetry, or a wired drill pipe. The MWD data is decoded at the surface by an MWD decoder 211. Generally, the decoded MWD data is sent to a directional driller's workstation and doghouse computer (see below).

Figure 2:
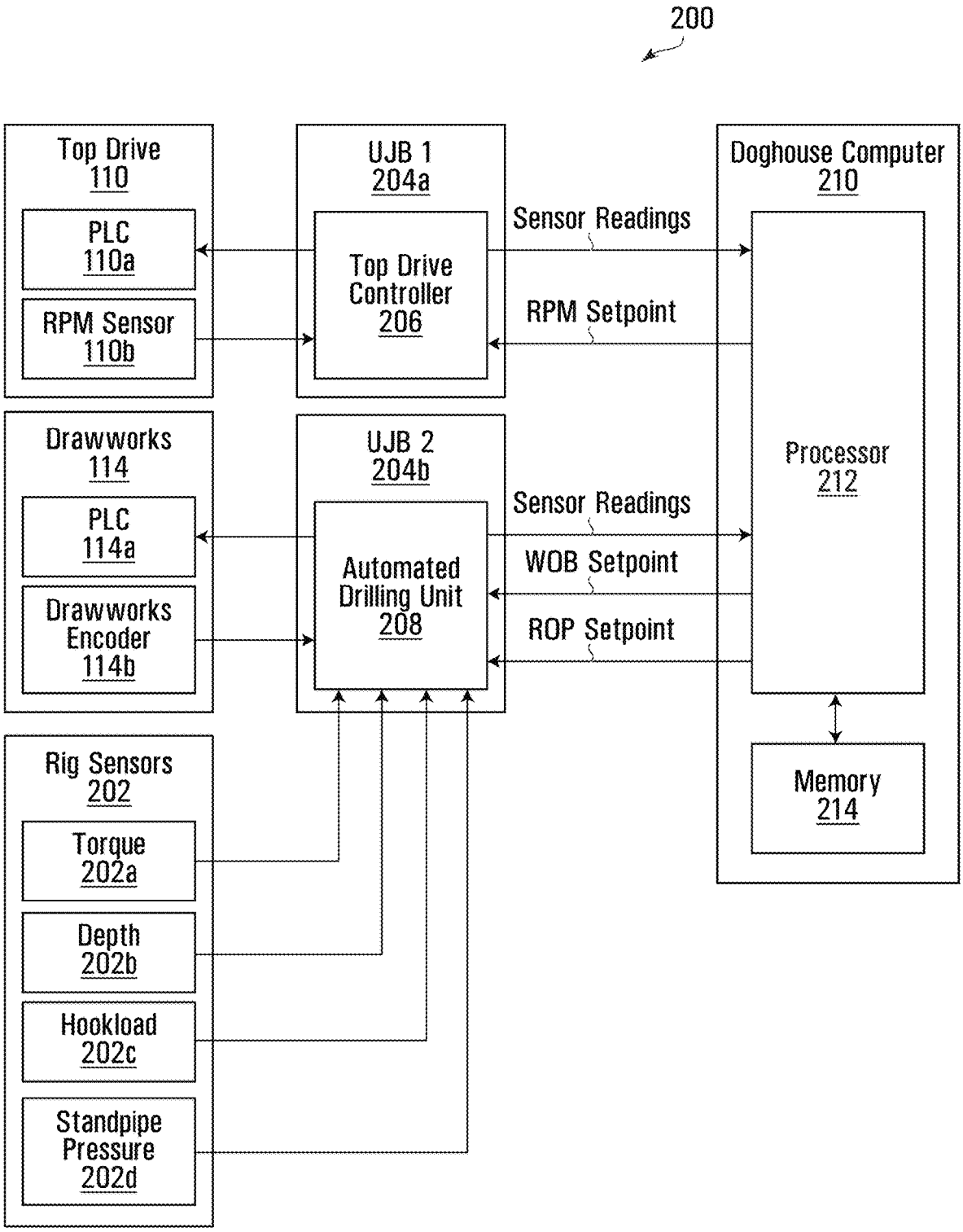
FIG. 2 is a first block diagram of a system for performing automated drilling of a wellbore, according to an embodiment of the disclosure.

FIG. 2 shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the travelling block 108. The top drive 110 comprises a top drive programmable logic controller ("top drive PLC") 110*a* that controls the top drive's 114 rotation and a revolutions-per-minute (RPM) sensor 110*b* that outputs the rotational rate of the drill string 118. More generally, the top drive PLC 110*a* is an example of a rotational drive unit controller and the RPM sensor 110*b* is an example of a rotation rate sensor. In addition, top drive 110 further includes a top drive rotary encoder 110*c* (mounted within or externally to the top drive 110). Top drive rotary encoder 110*c* is used to measure the angle of rotation of quill 111. Top drive rotary encoder 110*c* is an example of a rotational position sensor and is used to provide a feedback signal for controlling the toolface of the downhole tool, as described in further detail below.

A first junction box 204*a* houses a top drive controller 206, which is communicatively coupled to the top drive PLC 110*a*, the RPM sensor 110*b*, and the top drive rotary encoder 110*c*. The top drive controller 206 controls the rotation rate of the drill string 118 by instructing the top drive PLC 110*a* and obtains the rotational position, rate of rotation, and direction of rotation of the drill string 118 from top drive rotary encoder 110*c*.

A second junction box 204*b* houses an automated drilling unit 208 (or simply "automatic driller 208"), which is communicatively coupled to the drawworks PLC 114*a* and the drawworks encoder 114*b*. The automated drilling unit 208 modulates WOB during drilling by instructing the drawworks PLC 114*a* and obtains the height of the travelling block 108 from the drawworks encoder 114*b*. In different embodiments, the height of the travelling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the ROP of the drill bit 120 by monitoring the height of the travelling block 108 over time.

The system 200 also comprises a doghouse computer 210. The doghouse computer 210 comprises a toolface controller 212, and memory 214 communicatively coupled to each other. The memory 214 stores on it computer program code that is executable by the toolface controller 212 and that, when executed, causes the toolface controller 212 to perform methods for performing automated drilling of the wellbore 116. In particular, the toolface controller 212 may perform methods for controlling a toolface of the downhole tool, such as those described in U.S. Pat. No. 11,549,357 B2, incorporated herein by reference in its entirety. The toolface controller 212 receives readings from the RPM sensor 110*b*, drawworks encoder 114*b*, top drive rotary encoder 110*c*, and the rig sensors 202. MWD decoder 211, having received a toolface reading from downhole MWD tool 131, transmits the toolface reading directly to toolface controller 212.

The toolface controller 212 sends one or more of an ROP setpoint, a differential pressure setpoint, and a WOB setpoint to the automated drilling unit 208, and one or more of an RPM setpoint and a top drive position setpoint to the top drive controller 206. The top drive position setpoint may include a rotational position setpoint of the top drive 110 (indicative of a desired rotational position of the top drive 110), or a rotational position setpoint indicative of a target midpoint about which the top drive 110 is oscillated (or a target neutral point in the case of asymmetric oscillations). The top drive controller 206 and automated drilling unit 208 relay these setpoints to the top drive PLC 110*a* and drawworks PLC 114*a*, respectively, where they are used for automated drilling.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 206, automated drilling unit 208, and doghouse computer 210 are respective example types of drilling controllers. In the system 200 of FIG. 2, the top drive controller 206 and the automated drilling unit 208 are distinct and respectively use the RPM and top drive position setpoints, and the WOB, differential pressure, and ROP setpoints, for automated drilling. However, in different embodiments (not depicted), the functionality of the top drive controller 206 and automated drilling unit 208 may be combined or may be divided between three or more controllers. In certain embodiments (not depicted), the toolface controller 212 may directly communicate with any one or more of the top drive 110, drawworks 114, sensors 202, and MWD decoder 211. Additionally or alternatively, in different embodiments (not depicted) automated drilling may be done in response to only the RPM setpoint, only the ROP setpoint, only the WOB setpoint, only the differential pressure setpoint, only the top drive position setpoint, or any combination thereof, possibly in combination with one or more other drilling parameters. Examples of these additional drilling parameters comprise, for example, depth of cut, torque, and flow rate (into the wellbore 116, out of the wellbore 116, or both).

In the depicted embodiments, the top drive controller 206 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 206 and the automated drilling unit 208 may sample data at different rates, and more generally in embodiments in which different equipment is used data may be sampled from different sensors 202 at different rates.

Figure 3:
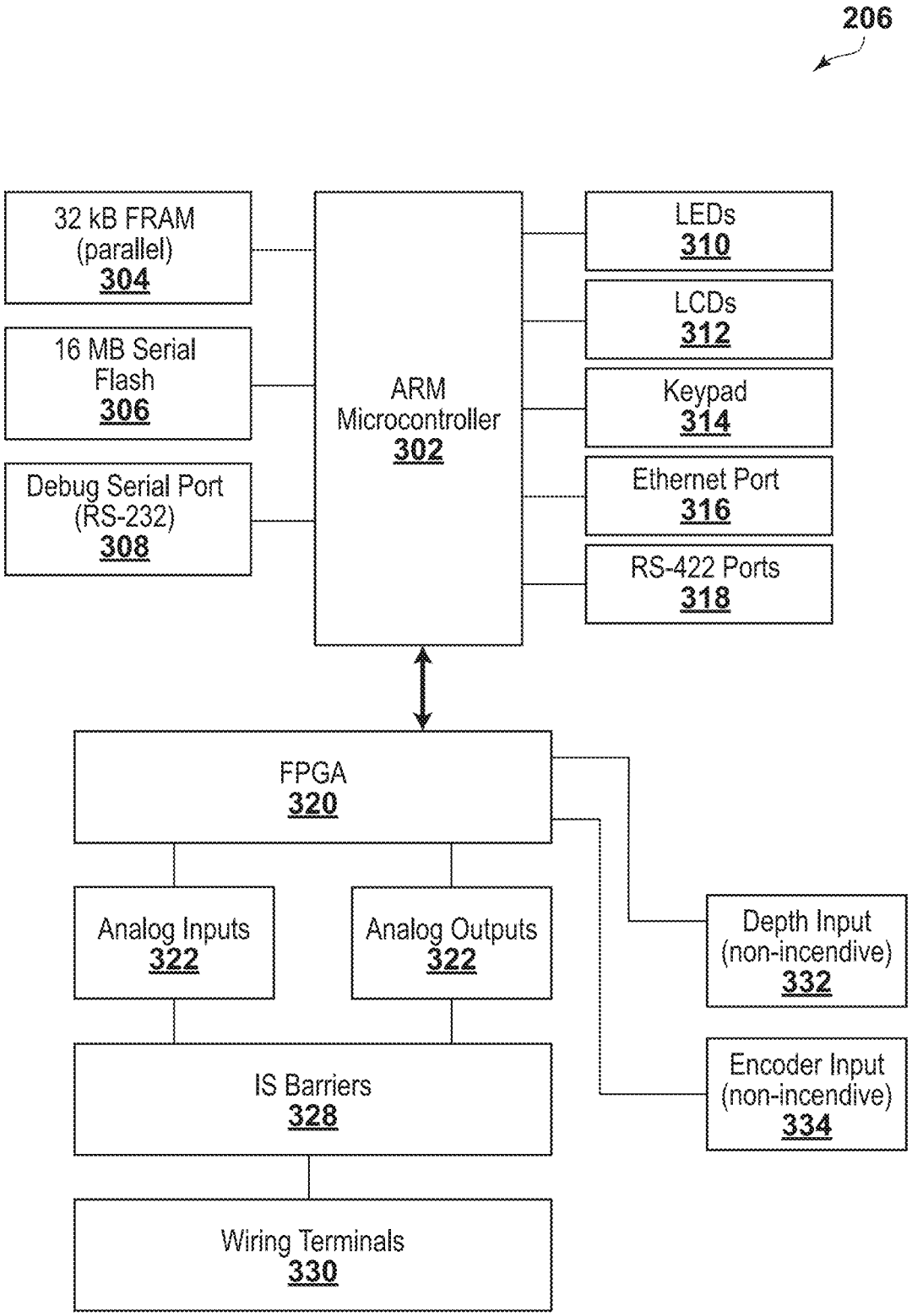
FIG. 3 is a second block diagram of a system for performing automated drilling of a wellbore, according to an embodiment of the disclosure.

Referring now to FIG. 3, there is shown a hardware block diagram 300 of the second junction box 204*b* of FIG. 2. The second junction box 204*b* comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16

MB of flash memory 306; a serial port 308 used for debugging purposes; LEDs 310, LCDs 312, and a keypad 314 to permit a driller to interface with the automatic driller 208; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 202*c*,202*d* via the FPGA 320. More specifically, the FPGA 320 receives signals from these sensors 202*c*,202*d* as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the PLC 114*a*; accordingly, the microcontroller 302 receives signals from a block height sensor (not shown) and the torque sensor 202*a* and sends signals to a variable frequency drive (or, in some embodiments, a braking device) via the RS-422 ports 318. According to some embodiments, automatic driller 208 outputs a throttle signal to a PLC using an analog output. According to some embodiments, automatic driller 208 communicates with a band brake controller using an RS-422 port.

The FPGA 320 is also communicatively coupled to a non-incendive depth input 332 and a non-incendive encoder input 334. In different embodiments (not depicted), the automatic driller 208 may receive different sensor readings in addition to or as an alternative to the readings obtained using the depicted sensors 202*a*,202*b*,202*c*,202*d*.

First junction box 204*a*, comprising top drive controller 206, comprises an input/output architecture similar to that of second junction box 204*b* shown in FIG. 3. However, the RS-422 port is not used, and all an inputs/outputs use analog or discrete digital signaling.

Figure 4:
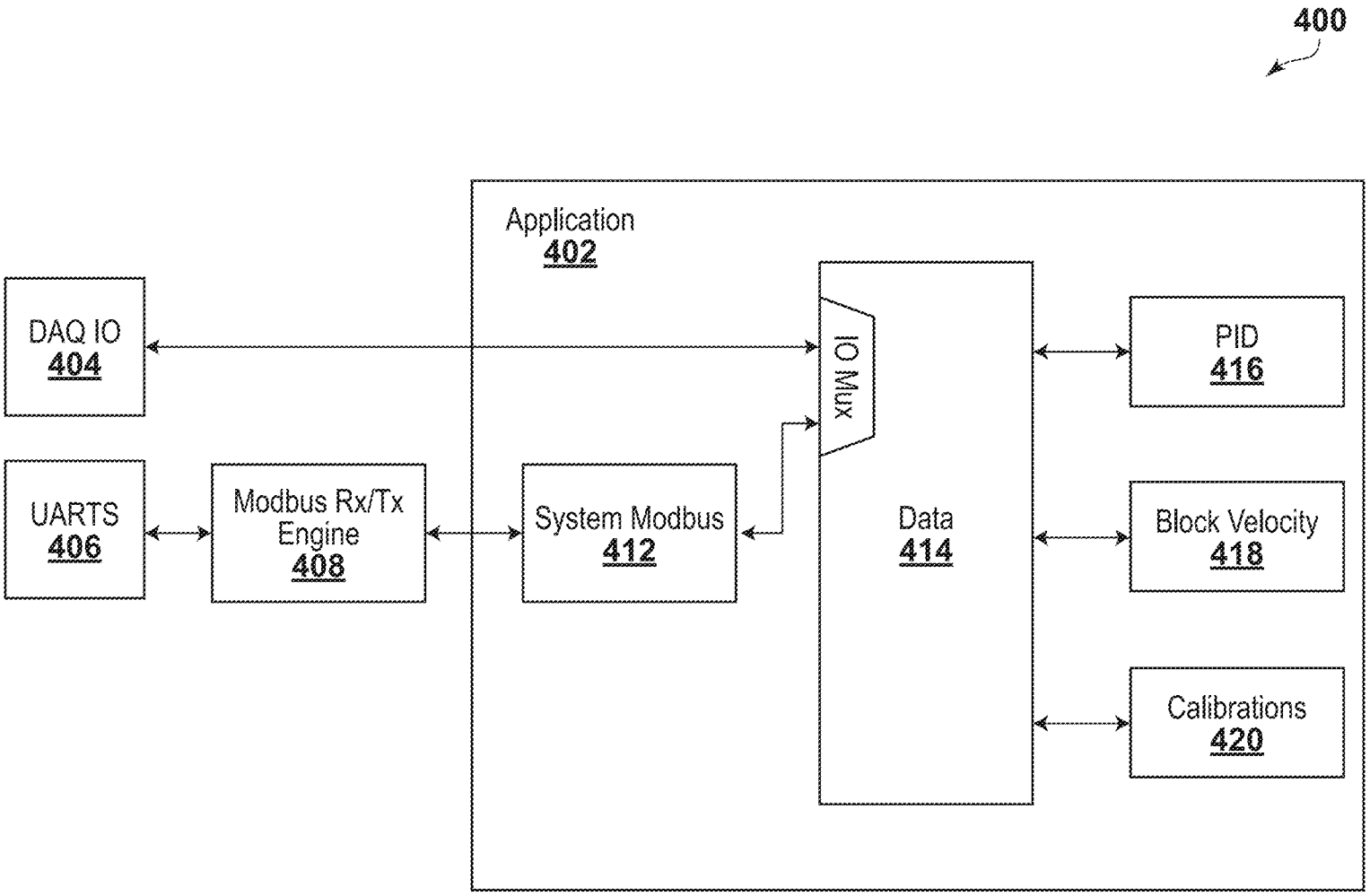
FIG. 4 is a block diagram of the automated drilling unit of FIGS. 2 and 3, according to an embodiment of the disclosure.

Referring now to FIG. 4, there is shown a block diagram of software modules, some of which comprise a software application 402, running on the automatic driller of FIG. 3. The application 402 comprises a data module 414 that is communicative with a PID module 416, a block velocity module 418, and a calibrations module 420. The microcontroller 302 runs multiple PID control loops in order to determine the signal to send to the PLC 114*a* to control the variable frequency drive; the microcontroller 302 does this in the PID module 416. The microcontroller 302 uses the block velocity module 418 to determine the velocity of the travelling block 108 from the travelling block height derived using measurements from the block height sensor. The microcontroller 302 uses the calibrations module 420 to convert the electrical signals received from the sensors 202*a*,202*b*,202*c*,202*d* into engineering units; for example, to convert a current signal from mA into kilopounds.

The data module 414 also communicates using an input/output multiplexer, labeled "10 Mux" in FIG. 4. In one of the multiplexer states the data module 414 communicates digitally via the Modbus protocol using the system modbus 412 module, which is communicative with a Modbus receive/transmit engine 408 and the UARTS 406. In another of the multiplexer states, the data module 414 communicates analog data directly using the data acquisition in/out module 404. While in FIG. 4 the Modbus protocol is shown as being used, in different embodiments (not depicted) a different protocol may be used, such as another suitable industrial bus communication protocol.

Figure 5:
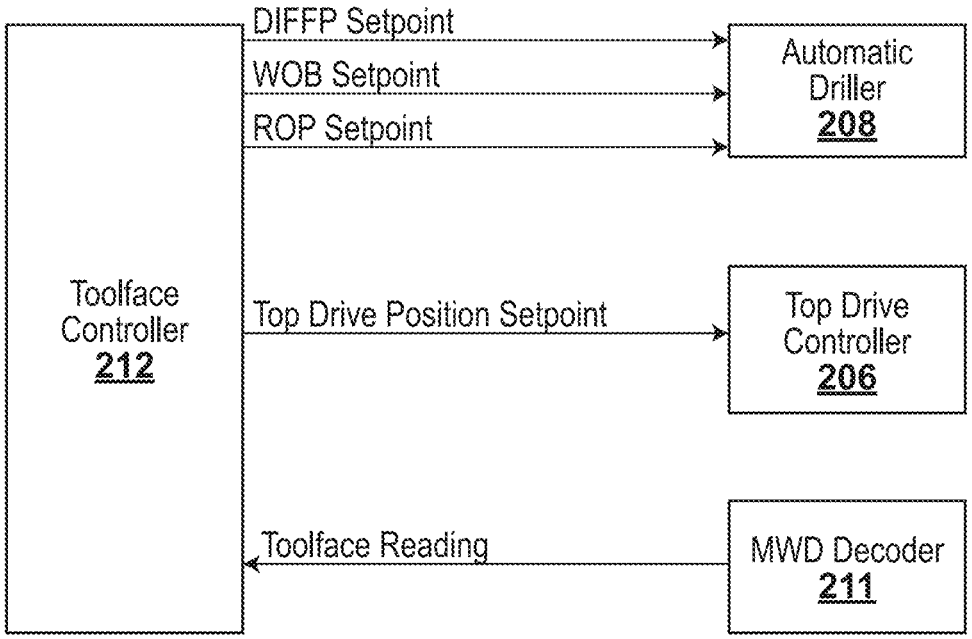
FIG. 5 is a block diagram of software modules running on the automated drilling unit of FIGS. 2 and 3, according to an embodiment of the disclosure.

Turning to FIG. 5, there is shown a block diagram of toolface controller 212 interacting with automatic driller 208, top drive controller 206, and MWD decoder 211. Toolface controller 212 determines, depending on the desired toolface correction, adjustments to one or more drilling parameter setpoints, and inputs the adjusted drilling parameter setpoint(s) to automatic driller 208 and/or top drive controller 206 to correct the toolface of the downhole tool, e.g. by minimizing a difference between a measured toolface and the toolface setpoint (e.g. a desired toolface).

As described above, top drive controller 206 manages the rotation of drill string 118, controls the oscillation of drill string 118, and effects changes to the rotational position of top drive 110. When performing rotational drilling, top drive controller 206 rotates drill string 118 constantly in the same direction (e.g. to the right). When sliding, in order to maintain toolface control, top drive controller 206 provides changes to one or more of a rotational position of the top drive 110 and a midpoint (or neutral point) about which the top drive 110 is oscillated. Generally, when sliding in the lateral, top drive controller 206 oscillates the top of drill string 118 a set amount in each direction. This reduces friction along drill string 118 and allows for smoother sliding. The amount of oscillation is chosen to allow most of drill string 118 to have some rotation without this rotation reaching the downhole tool. Changes to the midpoint or neutral point of this oscillation will propagate to the toolface over time. While oscillation can be used during vertical drilling and in the build, it is generally more often used while drilling in the lateral.

MWD decoder 211 receives from MWD tool 131 encoded data relating the toolface of the downhole tool (e.g. every 30 seconds, for example). MWD decoder 211 may decode the data to determine the current toolface and provides the toolface reading to toolface controller 212. MWD decoding can be performed through a variety of means, depending on how the data is sent. If the data is transmitted using mud-pulse telemetry, then MWD decoder 211 uses pressure information from a pressure sensor, such as standpipe pressure sensor 202*d*, to identify signals sent through the mud. MWD decoder 211 decodes the data and sends the toolface reading to toolface controller 212. The frequency of the updates to the current toolface may depend on equipment, conditions, and depth.

Figure 6:
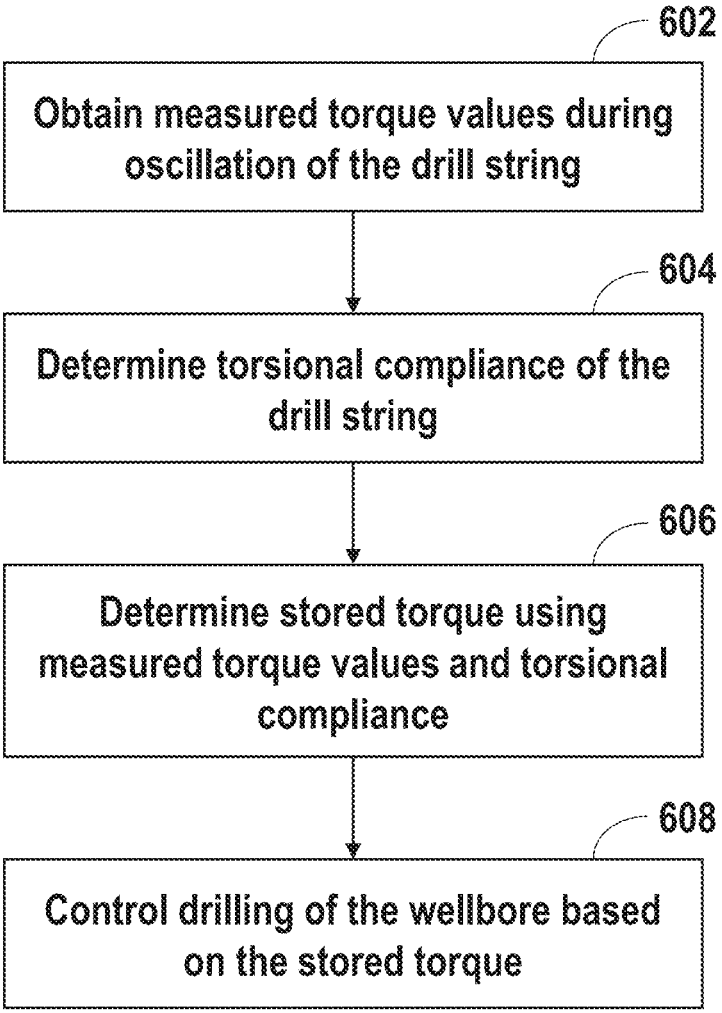
FIG. 6 depicts a flow diagram of a method of controlling a drilling operation by adjusting one or more drilling parameter setpoints based on torque stored in the drill string, according to an embodiment of the disclosure.

Turning now to FIG. 6, there is shown a flow diagram of a method of controlling a drilling operation by adjusting one or more drilling parameter setpoints based on torque stored in the drill string, according to an embodiment of the disclosure. The flow diagram illustrates a series of blocks representing actions performed by one or more processors to enhance drilling accuracy and operational stability.

At block 602, measured torque values are obtained during oscillation of the drill string. During this process, the drill string alternates between clockwise and counter-clockwise rotational movement, resulting in oscillatory motion. Torque sensors, such as the torque sensor shown in FIG. 2A (202*a*), measure the torque applied at various rotational positions of the drill string. These measurements may be transmitted to the doghouse computer (210 in FIG. 2A) through the automated drilling unit (208 in FIG. 2A), so that the measurements can be processed for further analysis.

At block 604, the torsional compliance of the drill string is determined. The torsional compliance represents the relationship between the applied torque and the angular displacement of the drill string. This value assists in understanding the mechanical behavior of the drill string and its response to oscillatory forces. The doghouse computer (210 in FIG. 2A), via the processor (212 in FIG. 2A), may determine the torsional compliance of the drill string by using physical parameters, such as the dimensions and material properties of the drill string. Alternatively, the torsional compliance may be estimated in a real-time manner based on measured differences in angular displacement and corresponding differences in torque, with the results optionally refined through a filtering process, such as an exponential filter.

At block 606, the stored torque is determined using the measured torque values obtained during oscillation and the determined torsional compliance. Stored torque refers to residual torque that accumulates in the drill string due to operational factors, such as previous drilling activities or downhole conditions. By analyzing the measured torque data in conjunction with the torsional compliance, the magnitude of stored torque that may influence the orientation of the toolface is identified.

At block 608, the drilling of the wellbore is controlled based on the stored torque. Using the stored torque as input, one or more drilling parameter setpoints, such as the topdrive position setpoints, are adjusted to counteract the effects of the stored torque. For example, if an increase in torque is desired, the ROP setpoint may be increased, which instructs the autodriller to drill faster, thereby indirectly leading to an increase in torque. Corrective adjustments to the setpoints help maintain the desired toolface orientation. These adjustments may be executed by components such as the top drive (110 in FIG. 1) under the control of the top drive controller (206 in FIG. 2A).

In addition to the adjustment of topdrive position setpoints for counteracting the effects of stored torque, alternative control strategies may be implemented to address stored torque under different operational scenarios. For example, adjustments to differential pressure based on corrected differential pressure setpoints may be made to alter the torque generated by a mud motor, thereby compensating for stored torque. Similarly, WOB may be modified based on corrected WOB setpoints to influence the interaction between the drill bit and the formation, indirectly mitigating the effects of stored torque. Additionally, the drilling rate may be adjusted based on corrected ROP setpoints to modify the drilling rate, thereby indirectly controlling torque dynamics. One or more of these adjustments, tailored to the specific operational conditions and rig parameters, may be employed to provide a comprehensive approach to torque management.

Oscillation Peaks Approach

In a first embodiment, a process of controlling a drilling operation involves determining stored torque in a drill string by analyzing torque values obtained during oscillation. The process begins by oscillating the drill string in alternating rotational directions, specifically CW and CCW. For example, this oscillation may be carried out using the top drive (110 in FIG. 1) under the control of the top drive controller (206 in FIG. 2A). The oscillation is used to generate a range of rotational positions, during which torque values are measured using the torque sensor (202*a* in FIG. 2A) and angular displacement data is captured, which is indicative of the extent of rotation of the topdrive connected to the drill string.

The oscillation peaks, which represent rotational positions of interest, are identified during this process. These peaks may correspond to one of two variants: (1) the points where the measured torque reaches its maximum values during CW and CCW oscillations, or (2) the points where the angular displacement of the topdrive reaches its maximum values during CW and CCW oscillations. Both variants represent moments of interest during the oscillation cycle and can be identified by the processor (212 in FIG. 2A) of the doghouse computer (210 in FIG. 2A), for example.

Once the oscillation peaks are identified, the measured torque values ($T_{measured}$) at these peaks may be obtained via the torque sensor (202*a* in FIG. 2A). For the first variant, the torque values correspond to the points of maximum measured torque during CW and CCW oscillations. For the second variant, the torque values correspond to the points of maximum angular displacement of the topdrive during CW and CCW oscillations.

The torsional compliance of the drill string is then determined to characterize the relationship between applied torque and angular displacement. A total torsional compliance ($\lambda_{total}$) may be calculated by summing the torsional compliance of each segment of the drill string, as expressed by the equation:

$$\lambda_{total}=\Sigma\lambda_i \tag{1}$$

For each segment i, the torsional compliance ($\lambda_i$) is determined using the following equation:

$$\lambda_i = \frac{1}{G \cdot J} \cdot L \tag{2}$$

where G represents the shear modulus of the material of the i-th segment, L is the length of the i-th segment, and J is the torsional moment of inertia. The moment of inertia is calculated as:

$$J = \frac{\pi}{32} \cdot (OD^4 - ID^4) \tag{3}$$

where OD and ID are the outer and inner diameters of the i-th segment, respectively.

In this approach, the torsional compliance ($\lambda_{total}$) is determined based on the physical properties of the drill string, such as its dimensions (L, OD, and ID) and material characteristics (G). Once the torsional compliance is established, the twist oscillating torque ($\tau_{TwistOscillating}$) can be calculated for each oscillation peak. The twist oscillating torque represents the torque caused by the elastic deformation of the drill string during oscillation. The twist oscillating torque is expressed by the equation:

$$\tau_{TwistOscillating} = \frac{(\text{Topdrive Position} - \text{Topdrive Position Setpoint})}{\lambda_{total}} \tag{4}$$

where Topdrive Position represents the angular displacement of the topdrive at the oscillation peaks, and Topdrive Position Setpoint represents a predetermined neutral position of the topdrive.

The net torque values at the CW and CCW oscillation peaks are then determined by subtracting the twist oscillating torque and reactive torque ($\tau_{reactive}$) from the measured torque values. Reactive torque refers to the counteracting torque generated by the interaction between the drill bit and the formation during drilling. It is influenced by the cutting resistance of the formation and the operational parameters of the downhole mud motor, such as differential pressure and flow rate. For the CW peak, the net torque ($\tau_{OscCW}$) is calculated as:

$$\tau_{OcsCW}=\tau_{measured}-\tau_{TwistOscillating}-\tau_{reactive} \quad (5)$$

For the CCW peak, the net torque ($\tau_{OscCCW}$) is expressed as:

$$\tau_{OcsCCW}=\tau_{measured}-\tau_{TwistOscillating}-\tau_{reactive} \quad (6)$$

If the drill bit is not in contact with the bottom of the wellbore (off-bottom), $T_{reactive}$ is equal to zero. If the drill bit is in contact with the bottom of the wellbore (on-bottom), $T_{reactive}$ accounts for the resistance from the formation, which may be derived from mud motor specifications or other parameters.

The specifications of the mud motor, as provided by the manufacturer, generally detail operational and performance characteristics of the mud motor. These specifications typically include data such as the maximum torque the mud motor can generate, the relationship between differential pressure across the motor and the torque output, and the operational limits of the motor (e.g., maximum pressure, flow rate, and RPM).

When oscillating the drill string in CW and CCW directions, the torque dynamics can be analyzed using the following equations. The torque during CW oscillation ($\tau_{OscCW}$) includes components from friction ($\tau_{friction}$), the twist oscillating torque ($\tau_{TwistOscillating}$), the stored torque ($\tau_{stored}$), and the reactive torque ($\tau_{reactive}$):

$$\tau_{OcsCW}=\tau_{friction}+\tau_{TwistOscillating}+\tau_{stored}+\tau_{reactive} \quad (7)$$

Similarly, the torque during CCW oscillation ($\tau_{OcsCCW}$) can be expressed as:

$$\tau_{OcsCCW}=\tau_{friction}+\tau_{TwistOscillating}+\tau_{stored}+\tau_{reactive} \quad (8)$$

These equations reflect the torque contributions during both directions of oscillation. The friction torque ($\tau_{friction}$) and the twist oscillating torque ($\tau_{TwistOscillating}$) are approximately equal in magnitude but opposite in sign for CW and CCW oscillations.

By combining the two equations (7) and (8), the frictional and twist oscillating torques cancel out due to the opposite signs, leaving an equation to calculate the stored torque ($\tau_{stored}$):

$$\tau_{stored} = \frac{\tau_{OcsCW} + \tau_{OcsCCW}}{2} \quad (9)$$

In this approach, $\tau_{OcsCW}$ and $\tau_{OcsCCW}$ are obtained from measurements at the oscillation peaks. The reactive torque ($\tau_{reactive}$) is either derived from the mud motor specifications or set to zero if the drill bit is off-bottom.

To estimate reactive torque, mud motor specifications may be used, which can provide a relationship between differential pressure and torque output. For example, a specification may indicate that a given pressure (e.g., 500 psi) produces a corresponding torque (e.g., 1,500 ft-lbs). Using the measured differential pressure during operation and the specified torque-to-pressure ratio, the reactive torque can be derived.

Consequently, the stored torque ($\tau_{stored}$) can be determined by averaging the net torque contributions from CW and CCW oscillations. This value is then used to control the drilling operation to mitigate undesired effects of stored torque on the toolface orientation, as discussed above.

In this embodiment, it should be understood that if the twist generated during clockwise (CW) oscillation is assumed to be equal in magnitude but opposite in direction to that generated during counterclockwise (CCW) oscillation, the $\tau_{TwistOscillating}$ component will cancel out when equations (7) and (8) are summed, as previously discussed. Consequently, under this assumption, the calculation of $\tau_{TwistOscillating}$ may be omitted.

In this embodiment, determining stored torque using oscillation peaks can reduce noise and transient fluctuations while simplifying computations. By focusing on maximum angular displacement or measured torque during CW and CCW oscillations, accurate stored torque estimates can be obtained. These estimates are then used to adjust one or more drilling parameter setpoints, such as the topdrive position setpoint, to counteract the effects of stored torque on toolface orientation. Whether the drill bit is off-bottom or in contact with the bottom of the wellbore, this method may provide consistent and reliable stored torque determination.

Constant Rotational Speed Approach

In a second embodiment, a process for determining torque stored in a drill string involves analyzing measured torque values during a steady phase of oscillation where the drill string is rotated at a substantially constant rotational speed. This embodiment identifies and processes intermediate rotational positions during the steady phase to determine the stored torque.

To begin, the drill string is alternately oscillated in CW and CCW directions. This oscillation may be achieved using the top drive (110 in FIG. 1) under the control of the top drive controller (206 in FIG. 2A). During the oscillation, a steady phase is established, characterized by the drill string rotating at a substantially constant rotational speed. Optionally, the rotational speed may be maintained above a predetermined threshold to reduce noise and improve the accuracy of data collection. The threshold for this rotational speed can vary depending on the oscillator installed on the rig, the sensors in use, and other factors such as friction. In some instances, the threshold may be as low as slightly above 0 RPM, as rotation cannot occur at exactly 0 RPM. On other rigs, the threshold may be pushed to just below the oscillation speed, which can be as high as 90 RPM on some systems. In practice, a rotational speed of approximately 9 RPM may be chosen as it provides reliable results across a variety of rigs and oscillation sizes. This speed is also slightly below 10 RPM, which is typically the lowest common oscillation speed achieved by many rigs.

During the steady phase, torque values ($\tau_{measured}$) are recorded at multiple intermediate rotational positions of the drill string. These intermediate positions may represent points in time when the torque sensor (202*a* in FIG. 2A) captures torque measurements during CW and CCW oscillations. These measurements are used in conjunction with the angular displacement data of the topdrive to facilitate subsequent calculations.

The torsional compliance ($\lambda_{total}$) of the drill string may be determined based on its physical properties, as described in the first embodiment in relation to equations (1) to (3). This value is used to determine the twist oscillating torque ($\tau_{TwistOscillating}$) at each intermediate position. The twist oscillating torque ($\tau_{TwistOscillating}$) represents the torque generated by the elastic deformation of the drill string due to oscillation and is determined using equation (4) described in relation to the first embodiment.

Using the measured torque values ($\tau_{measured}$) and the calculated twist oscillating torque ($\tau_{TwistOscillating}$), the net torque ($\tau_{net}$) at each intermediate position is determined using the following equation:

$$\tau_{net}=\tau_{measured}-\tau_{TwistOscillating}-\tau_{reactive} \quad (10)$$

In this equation, the reactive torque ($\tau_{reactive}$) accounts for resistance from the formation if the drill bit is in contact with the bottom of the wellbore. If the drill bit is off-bottom, $T_{reactive}$ is equal to zero.

The net torques ($\tau_{net}$) calculated for the intermediate positions during CW oscillation may be averaged to obtain the net CW torque ($\tau_{OcsCW}$):

$$\tau_{OcsCW}=\frac{\sum \tau_{net}}{n}, \text{ during } CW \text{ oscillation(s)} \quad (11)$$

where n represents the number of torque measurements taken during the CW oscillation(s).

Similarly, the net torques for the intermediate positions during CCW oscillation are averaged to obtain the net CCW torque ($\tau_{OcsCCW}$):

$$\tau_{OcsCCW}=\frac{\sum \tau_{net}}{m}, \text{ during } CCW \text{ oscillation(s)} \quad (12)$$

where m represents the number of torque measurements taken during the CCW oscillation(s).

The stored torque ($\tau_{stored}$) is then determined by equation (9) described in relation to the first embodiment.

In this embodiment, the ability to use multiple intermediate points during a steady phase of oscillation provides an alternative way to determine the stored torque by averaging out noise and transient variations in the measurements. The stored torque is subsequently used to adjust one or more drilling parameter setpoints, such as the topdrive position setpoint, to mitigate its impact on the toolface orientation. Whether the drill bit is off-bottom or in contact with the bottom of the wellbore, this method may ensure consistent determination of stored torque.

Determining Torsional Compliance Using Instantaneous Compliance Values

In a third embodiment, a process is provided for determining the torsional compliance of a drill string during a drilling operation by using instantaneous compliance values determined over a time interval during oscillation. This embodiment may be suited to scenarios where the drill string is oscillated at a substantially constant rotational speed (steady phase), such as described in relation to the second embodiment. By analyzing the relationship between angular displacement and torque in a real-time manner, this approach provides an alternative to directly calculating torsional compliance using physical parameters of the drill string.

During the steady phase of oscillation, real-time measurements of angular displacement and torque may be obtained, such as from the topdrive position and torque sensors (e.g., 202*a* in FIG. 2A). The steady phase may be defined by a substantially constant rotational speed that exceeds a predetermined threshold value, such as a value between 5 and 13 RPM, for example 9 RPM. Meeting a certain rotational speed may improve stability and reduce noise in the measurements by reducing fluctuations in friction and caused by inconsistent rotational motion at lower rotational speeds. At specific intervals within this phase, differences in angular displacement (ΔTopdrive Position) and corresponding differences in torque (Δτ) are calculated as follows:

$$\Delta\text{Topdrive Position}=\text{Topdrive Position}_i-\text{Topdrive Position}_{i-1} \quad (13)$$

$$\Delta\tau=\tau_i-\tau_{i-1} \quad (14)$$

where i and i−1 represent successive time points within the same steady-phase time interval. The indices i and i−1 allow the calculation of differences in angular displacement and torque over a time span.

Using these differences, an instantaneous torsional compliance ($\tau_{inst}$) at each time point may be determined, expressed by:

$$\lambda_{inst}=\frac{\Delta\text{Topdrive Position}}{\Delta\tau} \quad (15)$$

where $\lambda_{inst}$ represents the compliance of the drill string based on the relationship between angular displacement and torque at the specific point in time.

To ensure accurate and meaningful compliance calculations, the following conditions may be applied: (1) the rotational speed should remain stable and exceed a predetermined speed value during the interval, such as 9 RPM; (2) the signs of ΔTopdrive Position and Δτ should match, indicating consistent directional behavior; and (3) the magnitude of Δτ should exceed a predetermined torque threshold to filter out minor fluctuations. The threshold for Δτ may vary depending on rig configurations and sensor accuracy. At a minimum, the threshold should be greater than 0 to avoid division by zero during calculations. In typical operations, a minimum threshold of 0.1 kNm is commonly used as it may balance sensitivity and reliability. On rigs with clean torque measurements—enabled by precise topdrive behavior and advanced sensors—this threshold may be reduced to slightly above 0. Conversely, on rigs with higher oscillation speeds or greater torque variability, thresholds up to 5 kNm may be used to allow for meaningful data. If all these conditions are met, $\lambda_{inst}$ is calculated at the corresponding time point.

Once calculated, the instantaneous compliance values may be processed through an exponential filter to generate a smoothed torsional compliance (λ). The exponential filter reduces the impact of noise and variances in the raw measurements. This process produces a more reliable value for use in subsequent calculations. The filtering process follows the equation:

$$\alpha=1-e^{-1/T} \quad (16)$$

$$\lambda_i=\alpha\cdot\lambda_{inst}+(1-\alpha)\cdot\lambda_{i-1} \quad (17)$$

where T represents the time constant for the filter, determining the degree of smoothing applied to the compliance values. α weights the influence of the current instantaneous compliance ($\lambda_{inst}$) relative to the previously smoothed compliance ($\lambda_{i-1}$).

The time constant T can be defined in terms of the number of samples used for smoothing. For example, a time constant of 60 samples corresponds to the exponential filter smoothing compliance values over 60 data points. Larger values of T provide greater smoothing, while smaller values allow the compliance to respond more rapidly to changes.

If the specified conditions for calculating $\lambda_{inst}$ are not met during a given interval, the update for that interval may be skipped, so as to ensure that inaccurate or noisy data does not influence the final compliance value.

The smoothed torsional compliance ($\lambda$) obtained through this process is then used in subsequent calculations, such as determining the twist oscillating torque ($\tau_{TwistOscillating}$) or the stored torque ($\tau_{stored}$), as described in relation to the first and second embodiments. This approach accounts for variabilities in torque calibration and uneven twisting across different segments of the drill string (e.g., due to increased friction in lateral sections compared to vertical sections), thereby enhancing the robustness and reliability of the stored torque determination process.

Application of Stored Torque in Drilling Operations

The determination of stored torque facilitates effective control of drilling operations. In some embodiments, stored torque may be removed in a single adjustment under specific conditions. These conditions may include: (1) when toolface control (TFC) is first activated, to address any steering adjustments made by the driller prior to activation; (2) following a differential pressure spike, which may introduce significant residual torque; or (3) after a fault in the VFD or other equipment.

For example, when TFC is activated off-bottom, the reactive torque ($T_{reactive}$) is zero, allowing the stored torque ($\tau_{stored}$) to be calculated and removed without interference from formation resistance. Alternatively, if TFC is activated on-bottom, the reactive torque is accounted for using mud motor specifications or other known parameters. With this configuration, any residual torque, such as that resulting from topdrive bumps or previous slides, can be removed.

In another embodiment, stored torque may be monitored and adjusted iteratively throughout the drilling process. For example, after an initial adjustment, the stored torque may be recalculated after a predetermined time interval (e.g., one minute). This interval accounts for changes introduced by TFC steering adjustments during the period.

Depending on the stored torque calculation, adjustments may be made as follows in some examples:

- If TFC has rotated the topdrive by 100 degrees, and the stored torque is calculated as 150 degrees in the same direction, the 100-degree steering adjustment is retained, and the excess 50 degrees of stored torque is removed.
- If TFC has rotated the topdrive by 100 degrees, and the stored torque is calculated as 50 degrees in the same direction, no adjustment to the stored torque is made, as it does not exceed the steering adjustment.
- If TFC has rotated the topdrive by 100 degrees, and the stored torque is calculated as 50 degrees in the opposite direction, the full 50 degrees of opposing stored torque is removed to maintain the intended toolface orientation.

This iterative process ensures that steering adjustments made by TFC are preserved while excess or opposing stored torque is managed appropriately to maintain the accuracy and stability of directional drilling.

Stored torque may be dynamically adjusted based on its alignment with the target toolface. If the stored torque is moving the toolface toward the target, it may be allowed to remain partially or entirely in the drill string until the toolface is within a defined threshold of the target. However, if the stored torque is moving the toolface away from the target, it may be removed completely to prevent deviation.

For example, if the stored torque is 360 degrees to the right and the required reactive torque is 180 degrees, 180 degrees of stored torque may be removed, eliminating the excess without applying reactive turns. If the stored torque is 90 degrees to the right and the reactive torque is 180 degrees, no stored torque is removed, and the reactive torque is applied as 90 degrees. These adjustments may be fine-tuned using adjustable parameters that allow partial or absolute retention of stored torque, ensuring stability without introducing opposing torque.

Adjustable tuning parameters may be incorporated to enhance flexibility in defining the degree to which stored torque is removed or retained. These parameters may include limits on the portion of stored torque allowed to remain in the drill string or absolute thresholds for torque retention. Such configurations ensure that adjustments are precise, so as to avoid overcorrections that may introduce opposing torque or destabilize the toolface.

Drilling Results

Figure 7:
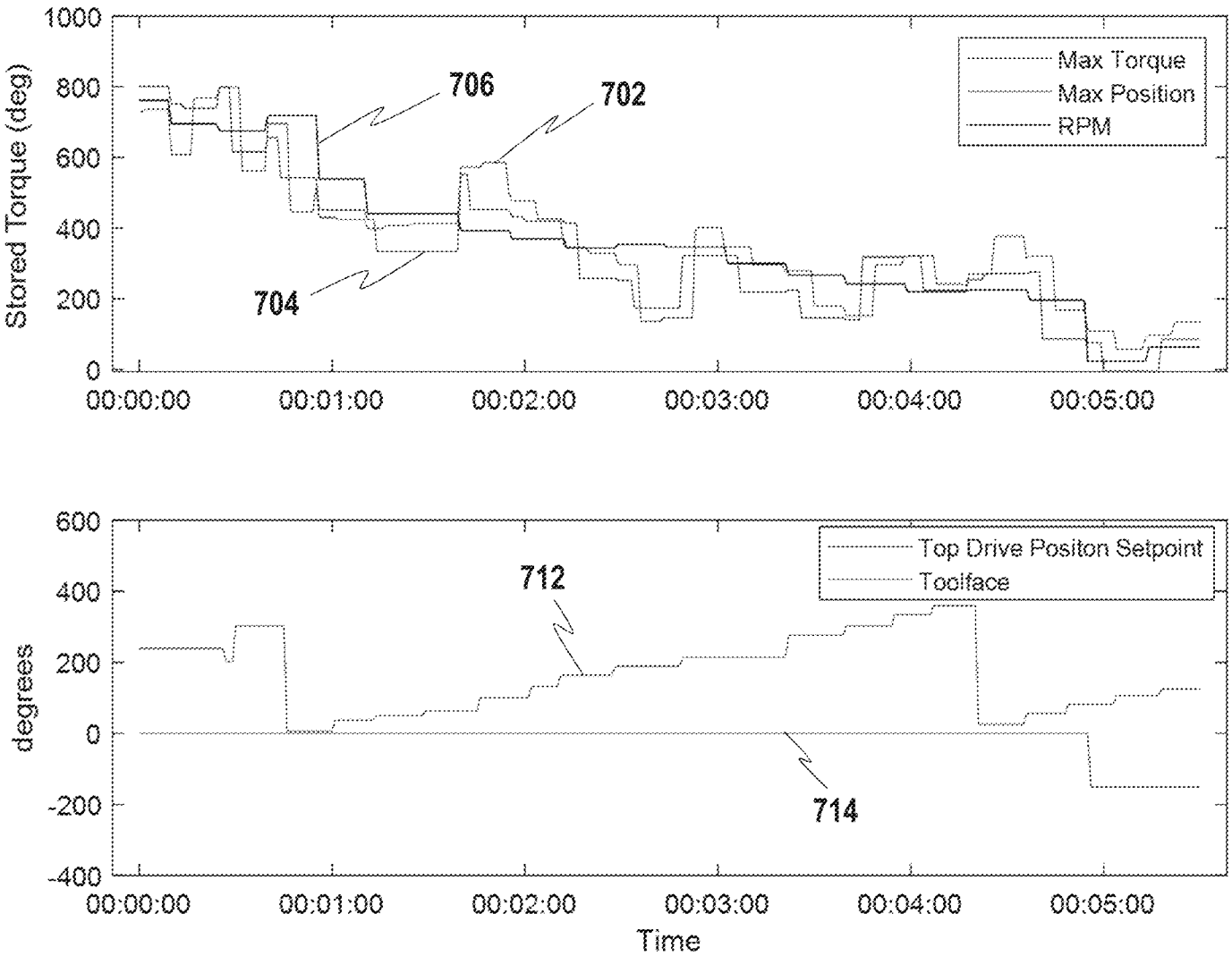
FIG. 7 depicts results of actual drilling operations in which stored torque was estimated according to various embodiments of the disclosure.

FIG. 7 illustrates the results of actual drilling operations, demonstrating the performance of three different embodiments of the stored torque estimation algorithm. The stored torque was represented over time, with three methods being compared for accuracy and noise levels.

In the first and second methods, stored torque was estimated by analyzing a single point during each oscillation cycle. The two methods, indicated as "Max Position" and "Max Torque" in FIG. 7 (labelled with 702 and 704, respectively), referred to the first embodiment described herein ("Oscillation Peaks Approach"), which used either the maximum angular position of the top drive during each oscillation cycle or the maximum torque value observed during each oscillation cycle to estimate stored torque.

In the third method, stored torque was estimated by analyzing multiple points during the steady phase of oscillation, defined by a substantially constant rotational speed. This method, indicated as "RPM" in FIG. 7 (labelled with 706), referred to the second embodiment described herein ("Constant Rotational Speed Approach"), which produced a cleaner and less noisy torque estimation, as shown in the top graph of FIG. 7.

The measurement results revealed that the method of the second embodiment provided improved noise reduction compared to the two methods of the first embodiment. However, it required larger oscillation sizes and was more dependent on accurately determining the sign and direction of torque. This improvement was evident in scenarios involving irregular top drive behavior, which highlights the advantages of using multiple data points during the steady phase of oscillation.

The bottom graph in FIG. 7 depicted the behavior of the toolface rotation (labelled with 712) and top drive position setpoints (labelled with 714) over the same time period. Initially, the toolface rotated in a clockwise direction due to the influence of stored torque within the drill string. The measurements recorded the angular position of the toolface unwrapping at 360 degrees, illustrating continuous clockwise rotation.

At approximately the 5-minute mark, toolface control was activated. Following this activation, adjustments to the top drive position setpoints were initiated to counteract the effects of the stored torque. The adjustments effectively reduced the residual stored torque in the drill string, bringing the toolface into alignment with the desired orientation (about −150 degrees). The results confirmed that activating toolface control, combined with appropriate setpoint modifications, successfully mitigated the undesirable effects of stored torque.

The drilling results in relation to FIG. 7 demonstrated the efficacy of different stored torque estimation methods and their impact on directional drilling control. These findings indicated that the selection of an estimation method and control strategy affects rig-specific parameters and operational conditions.

While particular embodiments have been described in the foregoing, it is to be understood that other embodiments are possible and are intended to be included herein. It will be clear to any person skilled in the art that modifications of and adjustments to the foregoing embodiments, not shown, are possible.

As an example, in the depicted embodiments the draw-works 114 is used to raise and lower the drill string 118. In different embodiments (not depicted), a different height control apparatus for raising or lowering the drill string 118 may be used. For example, hydraulics may be used for raising and lowering the drill string 118. In embodiments in which hydraulics are used, the traveling block 108 may be omitted, and consequently, the processor 212 does not use the height of the block 108 as a proxy for drill string height, as it does in the depicted embodiments. In those embodiments, the processor 212 may use output from a different type of height sensor to determine drill string position and calculate rate of penetration (ROP). For example, the position of the hydraulic actuator may be measured directly using linear displacement sensors, or, if crown sheaves are present, a rotary motion encoder may be installed on the sheaves' axle to digitize readings of their motion.

While a single processor 212 is depicted in FIG. 2A, in different embodiments (not depicted) the processor 212 may comprise multiple processors, one or more microprocessors, or a combination thereof. Similarly, in different embodiments (not depicted) the single memory 214 may comprise multiple memories. Any one or more of those memories may comprise, for example, mass memory storage, ROM, RAM, hard disk drives, optical disk drives (including CD and DVD drives), magnetic disk drives, magnetic tape drives (including LTO, DLT, DAT and DCC), flash drives, removable memory chips such as EPROM or PROM, or similar storage media as known in the art.

In different embodiments (not depicted), the computer 210 may also comprise other components for allowing computer programs or other instructions to be loaded. Those components may comprise, for example, a communications interface that allows software and data to be transferred between the computer 210 and external systems and networks. Examples of the communications interface comprise a modem, a network interface such as an Ethernet card, a wireless communication interface, or a serial or parallel communications port. Software and data transferred via the communications interface are in the form of signals which can be electronic, acoustic, electromagnetic, optical, or other signals capable of being received by the communications interface. The computer 210 may comprise multiple interfaces.

In certain embodiments (not depicted), input to and output from the computer 210 is administered by an input/output (I/O) interface. In these embodiments the computer 210 may further comprise a display and input devices in the form, for example, of a keyboard and mouse. The I/O interface administers control of the display, keyboard, and mouse. In certain additional embodiments (not depicted), the computer 210 also comprises a graphical processing unit. The graphical processing unit may also be used for computational purposes as an adjunct to, or instead of, the processor 210.

In all embodiments, the various components of the computer 210 may be communicatively coupled to one another either directly or indirectly by shared coupling to one or more suitable buses.

Directional terms such as "top", "bottom", "up", "down", "front", and "back" are used in this disclosure for the purpose of providing relative reference only, and are not intended to suggest any limitations on how any article is to be positioned during use, or to be mounted in an assembly or relative to an environment. The term "couple" and similar terms, and variants of them, as used in this disclosure are intended to include indirect and direct coupling unless otherwise indicated. For example, if a first component is communicatively coupled to a second component, those components may communicate directly with each other or indirectly via another component. Additionally, the singular forms "a", "an", and "the" as used in this disclosure are intended to include the plural forms as well, unless the context clearly indicates otherwise.

The word "approximately" as used in this description in conjunction with a number or metric means within 5% of that number or metric.

Use of language such as "at least one of X, Y, and Z," "at least one of X, Y, or Z," "at least one or more of X, Y, and Z," "at least one or more of X, Y, and/or Z," or "at least one of X, Y, and/or Z," is intended to be inclusive of both a single item (e.g., just X, or just Y, or just Z) and multiple items (e.g., {X and Y}, {X and Z}, {Y and Z}, or {X, Y, and Z}). The phrase "at least one of" and similar phrases are not intended to convey a requirement that each possible item must be present, although each possible item may be present.

It is contemplated that any feature of any aspect or embodiment discussed in this specification can be implemented or combined with any feature of any other aspect or embodiment discussed in this specification, except where those features have been explicitly described as mutually exclusive alternatives.

The invention claimed is:

1. A method of using one or more computer processors to control drilling of a wellbore, comprising:

obtaining, during oscillating of a drill string, one or more measured torque values at one or more rotational positions of the drill string, wherein during the oscillating the drill string is alternately rotated in clockwise and counter-clockwise directions, wherein the one or more rotational positions comprise a clockwise oscillation peak and a counter-clockwise oscillation peak;

determining a torsional compliance of the drill string;

determining a stored torque using the one or more measured torque values at the one or more rotational positions and using the torsional compliance, wherein determining the stored torque comprises determining the stored torque using respective measured torque values at the clockwise and counter-clockwise oscillation peaks and using the torsional compliance; and controlling the drilling of the wellbore based on the stored torque.

2. The method of claim 1, wherein the respective measured torque values are respective maximum measured torque values obtained when oscillating the drill string in the clockwise and counter-clockwise directions.

3. The method of claim 1, wherein the respective measured torque values are respective maximum measured torque values obtained at maximum angular displacements, in the clockwise and counter-clockwise directions, of a topdrive connected to the drill string.

4. The method of claim 1, wherein determining the stored torque comprises:

determining the stored torque by using the measured torque value at the clockwise oscillation peak and the measured torque value at the counter-clockwise oscillation peak.

5. The method of claim 1, wherein the drill string is oscillated while a drill bit of the drill string is spaced from a bottom of the wellbore.

6. The method of claim 4, wherein the drill string is oscillated while a drill bit of the drill string is in contact with a bottom of the wellbore, and wherein determining the stored torque further comprises subtracting a reactive torque from the corresponding measured torque value at the clockwise or counter-clockwise oscillation peak, respectively.

7. The method of claim 1, wherein the torsional compliance of the drill string is determined using one or more dimensions and a material property of the drill string.

8. The method of claim 7, wherein the drill string comprises a plurality of segments, wherein the one or more dimensions comprise an outer diameter of each of the plurality of segments, an inner diameter of each of the plurality of segments, and a length of each of the plurality of segments, and wherein the material property comprises a shear modulus of a material of each of the plurality of segments.

9. The method of claim 8, wherein the torsional compliance is calculated by:

$$\lambda_{total}=\Sigma\lambda_i,$$

wherein $$\lambda_i = \frac{1}{G \cdot J} \cdot L,$$

wherein $\lambda_{total}$ represents the torsional compliance of the drill string, $\lambda_i$ represents the torsional compliance for the i-th segment, G represents the shear modulus of the material of the i-th segment, L represents the length of the i-th segment, and J represents a torsional moment of inertia calculated by:

$$J = \frac{\pi}{32} \cdot (OD^4 - ID^4)$$

wherein OD represents the outer diameter of the i-th segment, and ID represents the inner diameter of the i-th segment.

10. The method of claim 1, wherein controlling the drilling comprises:

determining at least one of a corrected topdrive position setpoint, a corrected differential pressure setpoint, a corrected weight-on-bit (WOB) setpoint, or a corrected rate of penetration (ROP) setpoint based on the stored torque; and adjusting at least one of the following to counteract an effect of the stored torque on the toolface orientation:

a toolface orientation of a drill bit connected to the drill string based on the corrected topdrive position setpoint;

a differential pressure applied to a mud motor based on the corrected differential pressure setpoint;

a weight-on-bit applied to the drill bit based on the corrected WOB setpoint; and a drilling rate based on the corrected ROP setpoint.

11. The method of claim 1, further comprising:

iteratively determining the stored torque during the oscillating by continuously obtaining updated measured torque values at one or more rotational positions of the drill string.

12. The method of claim 1, wherein during the oscillating, the drill string rotates at a constant rotational speed during a steady phase, and wherein determining the torsional compliance of the drill string comprises:

determining one or more instantaneous torsional compliances during the steady phase in a time interval, based on a ratio of a difference in angular displacement of a topdrive connected to the drill string and a corresponding difference in measured torque; and filtering the one or more instantaneous torsional compliance values using an exponential filter to obtain a smoothed torsional compliance as the torsional compliance.

13. The method of claim 12, wherein the one or more instantaneous torsional compliances are calculated by:

$$\lambda_{inst} = \frac{\text{difference in angular displacement}}{\text{difference in torque}}$$

wherein $\lambda_{inst}$ represents the instantaneous torsional compliance, and wherein the calculation of the one or more instantaneous torsional compliances is performed if the following conditions are met:

the constant rotational speed is greater than a predetermined speed value, signs of the angular displacement difference and torque difference match, and a magnitude of the torque difference exceeds a predetermined torque value.

14. A non-transitory computer-readable medium having stored thereon computer program code configured when executed by one or more processors to cause the one or more processors to perform a method of controlling drilling of a wellbore, comprising:

obtaining, during oscillating of a drill string, one or more measured torque values at one or more rotational positions of the drill string, wherein during the oscillating the drill string is alternately rotated in clockwise and counter-clockwise directions, wherein the one or more rotational positions comprise a clockwise oscillation peak and a counter-clockwise oscillation peak;

determining a torsional compliance of the drill string;

determining a stored torque using the one or more measured torque values at the one or more rotational positions and using the torsional compliance, wherein determining the stored torque comprises determining the stored torque using respective measured torque values at the clockwise and counter-clockwise oscillation peaks and using the torsional compliance; and controlling the drilling of the wellbore based on the stored torque.

15. A drilling rig comprising:

a drill string having a drill bit at end thereof for drilling a wellbore;

one or more sensors for measuring rotational position of the drill string and torque of the drill bit, wherein the rotational position is indicative of an angular displacement of a topdrive connected to the drill string; and one or more processors configured to receive as inputs real-time measurements of the rotational position and the torque obtained by the one or more sensors, and configured to:

obtain, during oscillating of a drill string, one or more measured torque values at one or more rotational positions of the drill string, wherein during the oscillating the drill string is alternately rotated in clockwise and counter-clockwise directions, wherein the one or more rotational positions comprise a clockwise oscillation peak and a counter-clockwise oscillation peak;

determine a torsional compliance of the drill string;

determine a stored torque using the one or more measured torque values at the one or more rotational positions and using the torsional compliance, wherein the stored torque is determined using respective measured torque values at the clockwise and counter-clockwise oscillation peaks and using the torsional compliance; and control the drilling of the wellbore based on the stored torque.

16. A method of using one or more computer processors to control drilling of a wellbore, comprising:

obtaining, during oscillating of a drill string, one or more measured torque values at one or more rotational positions of the drill string, wherein during the oscillating the drill string is alternately rotated in clockwise and counter-clockwise directions, wherein the one or more rotational positions comprise one or more intermediate rotational positions;

determining a torsional compliance of the drill string;

determining a stored torque using the one or more measured torque values at the one or more rotational positions and using the torsional compliance, wherein determining the stored torque comprises determining the stored torque using the one or more measured torque values obtained when the drill string is at the one or more intermediate rotational positions and using the torsional compliance; and controlling the drilling of the wellbore based on the stored torque.

17. The method of claim 16, wherein during the oscillating, the drill string rotates at a constant rotational speed during a steady phase, and wherein the one or more intermediate rotational positions are rotational positions of the drill string during the steady phase.

18. The method of claim 17, wherein the steady phase comprises a period during which the drill string is rotated at an angular velocity above a predetermined threshold value.

19. The method of claim 16, wherein determining the stored torque comprises:

determining a twist oscillating torque at each of the one or more intermediate rotational positions using the torsional compliance and a difference between an angular displacement of a topdrive connected to the drill string and a predetermined neutral position of the topdrive;

determining a net torque at each of the one or more intermediate rotational positions by subtracting the twist oscillating torque from the measured torque value at the corresponding intermediate rotational position; and determining the stored torque by averaging the net torques over the one or more intermediate rotational positions in the clockwise and counter-clockwise directions.

20. The method of claim 19, wherein the drill string is oscillated while a drill bit of the drill string is spaced from a bottom of the wellbore.

21. The method of claim 19, wherein the drill string is oscillated while a drill bit of the drill string is in contact with a bottom of the wellbore, and wherein determining the net torque further comprises subtracting a reactive torque from the measured torque value.

22. The method of claim 16, wherein the torsional compliance of the drill string is determined using one or more dimensions and a material property of the drill string.

23. The method of claim 22, wherein the drill string comprises a plurality of segments, wherein the one or more dimensions comprise an outer diameter of each of the plurality of segments, an inner diameter of each of the plurality of segments, and a length of each of the plurality of segments, and wherein the material property comprises a shear modulus of a material of each of the plurality of segments.

24. The method of claim 23, wherein the torsional compliance is calculated by:

$$\lambda_{total} = \sum \lambda_i,$$

wherein $$\lambda_i = \frac{1}{G \cdot J} \cdot L,$$

wherein $\lambda_{total}$ represents the torsional compliance of the drill string, $\lambda_i$ represents the torsional compliance for the i-th segment, G represents the shear modulus of the material of the i-th segment, L represents the length of the i-th segment, and J represents a torsional moment of inertia calculated by:

$$J = \frac{\pi}{32} \cdot (OD^4 - ID^4)$$

wherein OD represents the outer diameter of the i-th segment, and ID represents the inner diameter of the i-th segment.

25. The method of claim 16, wherein controlling the drilling comprises:

determining at least one of a corrected topdrive position setpoint, a corrected differential pressure setpoint, a corrected weight-on-bit (WOB) setpoint, or a corrected rate of penetration (ROP) setpoint based on the stored torque; and adjusting at least one of the following to counteract an effect of the stored torque on the toolface orientation:

a toolface orientation of a drill bit connected to the drill string based on the corrected topdrive position setpoint;

a differential pressure applied to a mud motor based on the corrected differential pressure setpoint;

a weight-on-bit applied to the drill bit based on the corrected WOB setpoint; and a drilling rate based on the corrected ROP setpoint.

26. The method of claim 16, further comprising:

iteratively determining the stored torque during the oscillating by continuously obtaining updated measured torque values at one or more rotational positions of the drill string.

27. The method of claim 16, wherein during the oscillating, the drill string rotates at a constant rotational speed during a steady phase, and wherein determining the torsional compliance of the drill string comprises:

determining one or more instantaneous torsional compliances during the steady phase in a time interval, based on a ratio of a difference in angular displacement of a topdrive connected to the drill string and a corresponding difference in measured torque; and filtering the one or more instantaneous torsional compliance values using an exponential filter to obtain a smoothed torsional compliance as the torsional compliance.

28. The method of claim 27, wherein the one or more instantaneous torsional compliances are calculated by:

$$\lambda_{inst} = \frac{\text{difference in angular displacement}}{\text{difference in torque}}$$

wherein $\lambda_{inst}$ represents the instantaneous torsional compliance, and wherein the calculation of the one or more instantaneous torsional compliances is performed if the following conditions are met:

the constant rotational speed is greater than a predetermined speed value, signs of the angular displacement difference and torque difference match, and a magnitude of the torque difference exceeds a predetermined torque value.

29. A non-transitory computer-readable medium having stored thereon computer program code configured when executed by one or more processors to cause the one or more processors to perform a method of controlling drilling of a wellbore, comprising:

obtaining, during oscillating of a drill string, one or more measured torque values at one or more rotational positions of the drill string, wherein during the oscillating the drill string is alternately rotated in clockwise and counter-clockwise directions, wherein the one or more rotational positions comprise one or more intermediate rotational positions;

determining a torsional compliance of the drill string;

determining a stored torque using the one or more measured torque values at the one or more rotational positions and using the torsional compliance, wherein determining the stored torque comprises determining the stored torque using the one or more measured torque values obtained when the drill string is at the one or more intermediate rotational positions and using the torsional compliance; and controlling the drilling of the wellbore based on the stored torque.

30. A drilling rig comprising:

a drill string having a drill bit at end thereof for drilling a wellbore;

one or more sensors for measuring rotational position of the drill string and torque of the drill bit, wherein the rotational position is indicative of an angular displacement of a topdrive connected to the drill string; and one or more processors configured to receive as inputs real-time measurements of the rotational position and the torque obtained by the one or more sensors, and configured to:

obtain, during oscillating of a drill string, one or more measured torque values at one or more rotational positions of the drill string, wherein during the oscillating the drill string is alternately rotated in clockwise and counter-clockwise directions, wherein the one or more rotational positions comprise one or more intermediate rotational positions;

determine a torsional compliance of the drill string;

determine a stored torque using the one or more measured torque values at the one or more rotational positions and using the torsional compliance, wherein the stored torque is determined using the one or more measured torque values obtained when the drill string is at the one or more intermediate rotational positions and using the torsional compliance; and control the drilling of the wellbore based on the stored torque.

* * * * *